US005904596A

United States Patent [19]

Knaus et al.

[11] Patent Number: 5,904,596

[45] Date of Patent: May 18, 1999

[54] CABLE TERMINATOR

[75] Inventors: Gary A. Knaus; Andrew J. Kempf, both of Horseheads; Ronald P. Locati, Elmira; Michael R. Dean, Waverly, all of N.Y.

[73] Assignee: Thomas & Betts International, Inc., Sparks, Nev.

[21] Appl. No.: 08/891,892

[22] Filed: Jul. 14, 1997

Related U.S. Application Data

[60] Provisional application No. 60/021,927, Jul. 17, 1996.

[51] Int. Cl.[6] ..... H01R 13/66; H01P 1/26

[52] U.S. Cl. ..... 439/620; 333/22 R; 338/220

[58] Field of Search ..... 439/620; 333/22 R; 338/220

[56] References Cited

U.S. PATENT DOCUMENTS 4,838,813 6/1989 Pauza et al. ..... 439/620

FOREIGN PATENT DOCUMENTS 2604972 8/1977 Germany ..... 333/220 R

*Primary Examiner*—Gary F. Paumen

*Attorney, Agent, or Firm*—Weingarten, Schurgin, Gagnebin & Hayes LLP

[57] ABSTRACT

The present invention comprises a terminator which features an internal termination resistor and capacitor mounted on a substrate which is in electrical and mechanical communication with a center terminal pin at one end, and the connector body at the other end. The body of the terminator is grounded via the connection of the terminator to a cooperating connector. The present invention includes a support insulator which protects the internal components of the terminator by preventing transmission of tensile, torsional, and bending stresses through the terminal into the termination chip assembly. The stresses are absorbed by means of a supportive insulator which frictionally supports a textured section of the center terminal within the terminator. The stresses typically occur during installation or removal of the terminator to or from a connector. With the present invention it is possible to twist and bend the metal terminal of the terminator to the point of fracture without damaging the termination chip. Additionally, the performance of the terminator is improved since the connection from the substrate of the termination chip to the terminator body has been enhanced, thereby reducing the high levels of intermodulation distortion associated with prior art terminators.

18 Claims, 3 Drawing Sheets

CABLE TERMINATOR

CROSS REFERENCE TO RELATED APPLICATIONS

This application claims priority under 35 U.S.C. § 119(e) to provisional patent application serial number 60/021,927 filed Jul. 17, 1996; the disclosure of which is incorporated herein by reference.

BACKGROUND OF THE INVENTION

Coaxial cables are used in many applications, such as local area networks or cable television (CATV) systems. In these types of applications, when a computer system is removed from the local area network or a television receiver is removed from the CATV cabling network, the cable should be terminated to avoid undue signal reflections, noise or an impedance mismatch.

A terminator is an electronic device which absorbs surplus power in a cable system, improving signal quality. A terminator typically includes a body having a cavity therein, a termination chip positioned within the cavity, and a terminal which extends from the termination chip to beyond the end of the body. The terminal and the termination chip are fixed within the cavity of the body. The body includes a section for mating with a connector such that the terminal is brought into electrical communication with a center conductor of the connector when the terminator is mated with the connector. There are several terminators available in the marketplace. Most terminator designs are susceptible to damage when excessive force is applied to the center conductor, such as when the terminator is installed or removed from a cooperating connector. This is due to the fragile nature of the electronic components of the chip inside the assembly which are subjected to the forces applied to the terminal as part of the installation of the terminator onto a connector.

BRIEF SUMMARY OF THE INVENTION

The present invention comprises a terminator which features an internal termination resistor and capacitor mounted on a substrate which is in electrical and mechanical communication with a center terminal pin at one end, and the connector body at the other end. The body of the terminator is grounded via the connection of the terminator to a cooperating connector. The present invention includes a support insulator which protects the internal components of the terminator by preventing transmission of tensile, torsional, and bending stresses through the terminal into the termination chip assembly. The stresses are absorbed by means of a supportive insulator which frictionally supports a textured section of the center terminal within the terminator. The stresses typically occur during installation or removal of the terminator to or from a connector. With the present invention it is possible to twist and bend the metal terminal of the terminator to the point of fracture without damaging the termination chip. Additionally, the performance of the terminator is improved since the connection from the substrate of the termination chip to the terminator body has been enhanced, thereby reducing the high levels of intermodulation distortion associated with prior art terminators.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Figure 1:
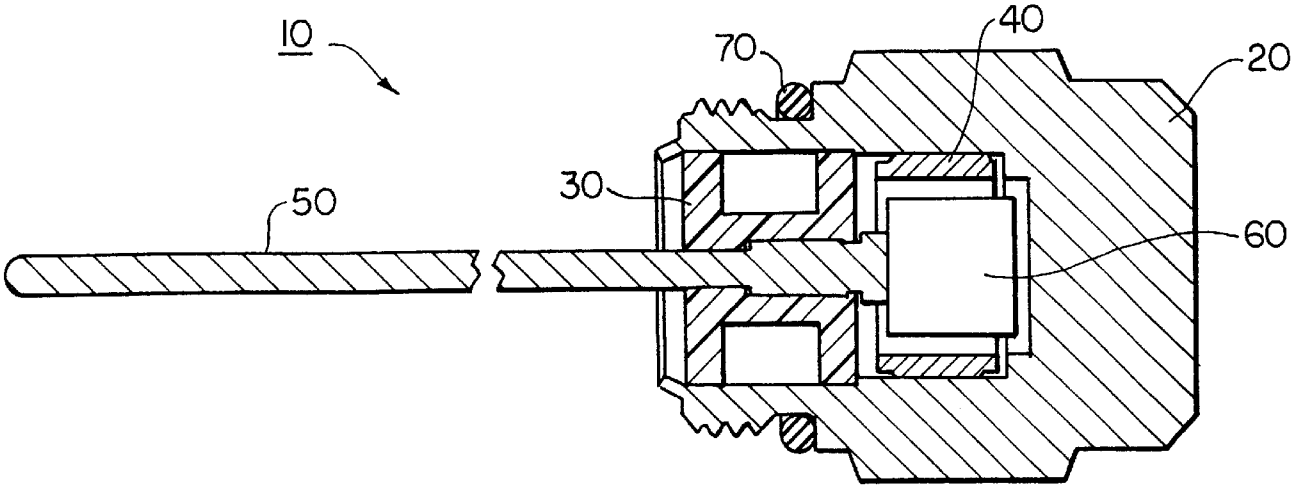
FIG. 1 is a cross-sectional view of the terminator of the present invention.

A terminator which protects the internal components from tensile, torsional and bending forces and also having improved performance is presented. FIG. 1 shows the terminator 10 of the present invention. The terminator 10 is comprised of an electrically conductive body 20, a support insulator 30, a compression ring 40, a terminal 50, a termination chip 60 and an optional o-ring 70.

Figure 2B:
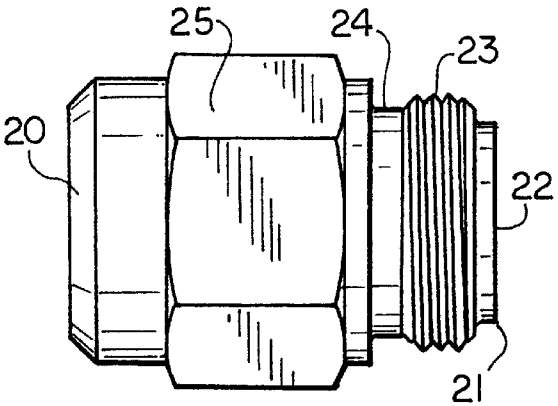
FIG. 2B is a side view of the body of FIG. 2.
Figure 2A:
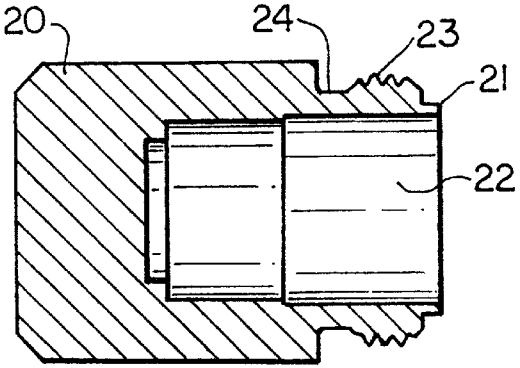
FIG. 2A is a cross-sectional side view of the body of FIG. 2.
Figure 2:
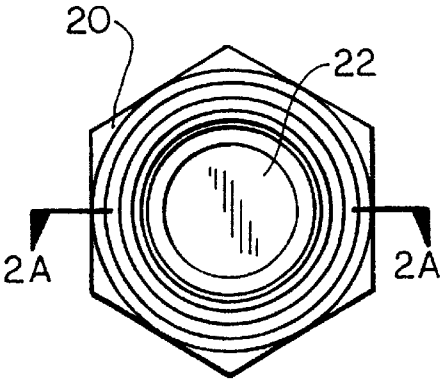
FIG. 2 is an end view of the body of the terminator of the present invention.

Referring now to FIGS. 2–2B, body 20 is shown. The body 20 includes a first end 21 having a central bore 22 partially disposed therein. Threads 23 are disposed about an outside surface of body 20 adjacent the first end for engaging a cooperating connector (not shown). An annular shoulder 24 is provided for receiving an o-ring (not shown) to provide a weather tight seal when the terminator is installed into a connector. Body 20 is comprised of aluminum, though other electrically conductive materials could also be used. Body 20 also includes a hexagonal shaped exterior portion 25 for allowing tightening of the terminator 10 to the connector by hand or by a tool.

Figure 3:
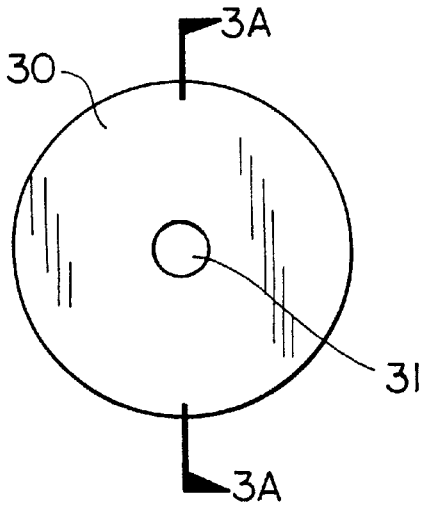
FIG. 3 is an end view of the insulator of the terminator.
Figure 3A:
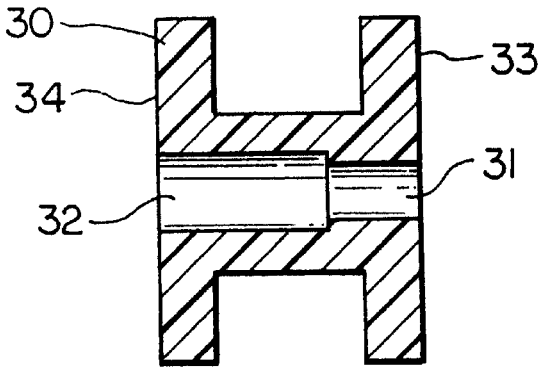
FIG. 3A is a cross-sectional side view of the insulator of FIG. 3.

FIGS. 3 and 3A show support insulator 30. Support insulator 30 is comprised of teflon or other non-conductive material and is disposed along a central longitudinal axis within the bore of the body. Support insulator 30 has a central bore 31 partially disposed within first end 33 which is adapted to receive a section of the terminal (not shown) therein and to engage the surface of the terminal thereby providing electrical insulation and mechanical support of the terminal within the body. A second central bore 32 is partially disposed within second end 34 and is adapted to receive a section of the terminal which includes a textured surface, such as a knurled or ridged surface, for providing additional mechanical support and stability. The internal components of the terminator are protected from tensile, torsional and bending stresses through the terminal by absorption of these forces by the support insulator 30.

Figure 4:
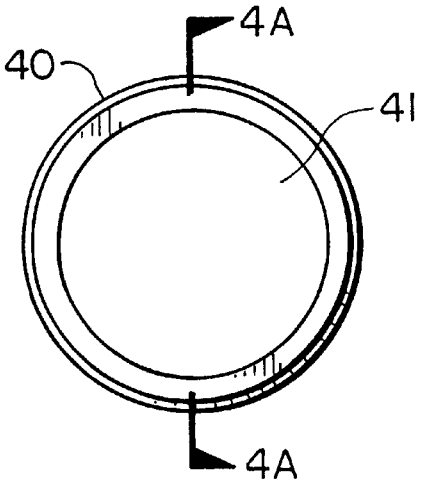
FIG. 4 is an end view of the compression ring of the terminator.
Figure 4A:
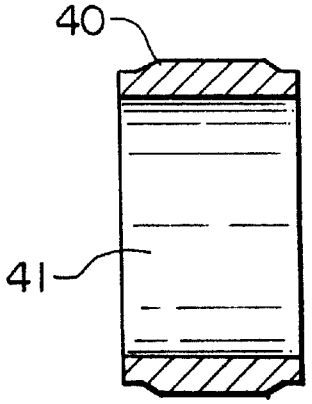
FIG. 4A is a cross-sectional view of the compression ring of FIG. 4.

Referring now to FIG. 4, a compression ring 40 is shown. Compression ring 40 is comprised of a conductive material, such as brass, and has a central bore 41 disposed therethrough. Central bore 41 is sized to receive a termination chip (not shown) therein. Compression ring 40 is sized to fit within the cavity of the body and to be in electrical communication with the body and with a contact of the termination chip. By use of the conductive compression ring the contact between the termination chip and the body is improved, such that intermodulation distortion has been minimized or removed.

Figure 5:
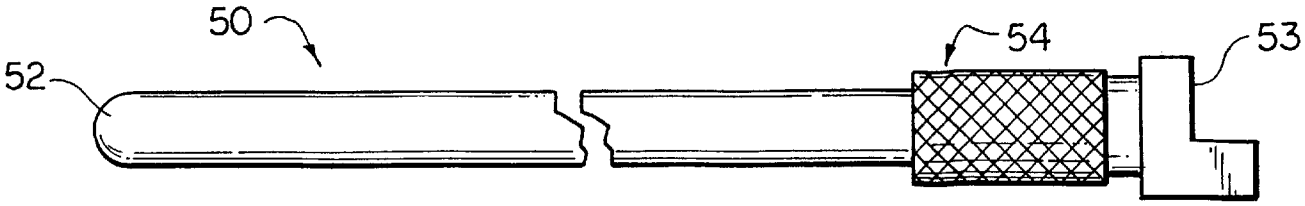
FIG. 5 is a side view of the terminal of the terminator.

FIG. 5 shows terminal 50. Terminal 50 includes a first end 52 and a second end 53. Terminal 50 is comprised of brass or other conductive material. A portion 54 of terminal 50 has a textured surface, such as that produced by knurling, which fits into the insulator and aids in the insulator absorbing the torsional, tensile and bending stresses occurring on the terminal during installation and removal of the terminator from and to a connector. While terminal 50 in this embodiment has a first end which is rounded, it should be appreciated that other end shapes could also be utilized. The second end 53 of terminal 50 is adapted to provide a secure mechanical and electrical connection with a contact of the termination chip.

Figure 6:
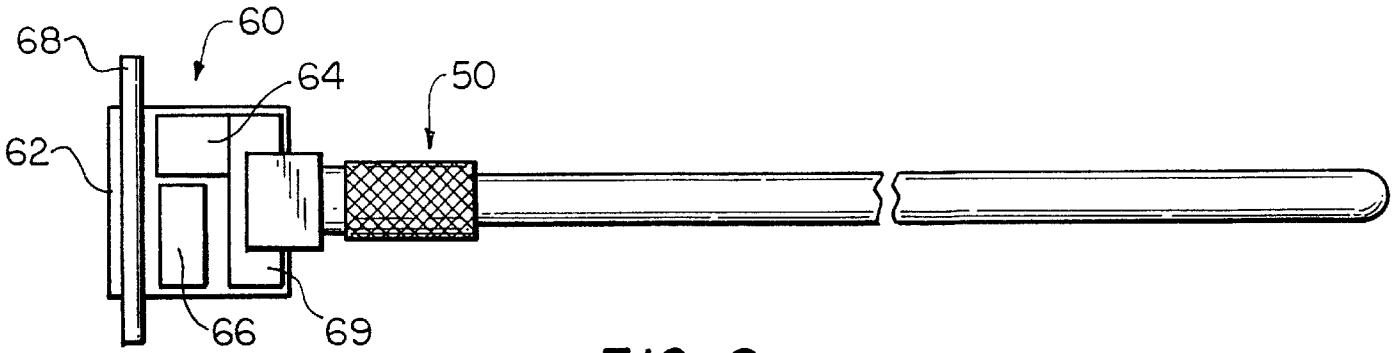
FIG. 6 is a top view of the termination chip attached to the terminal.
Figure 6A:
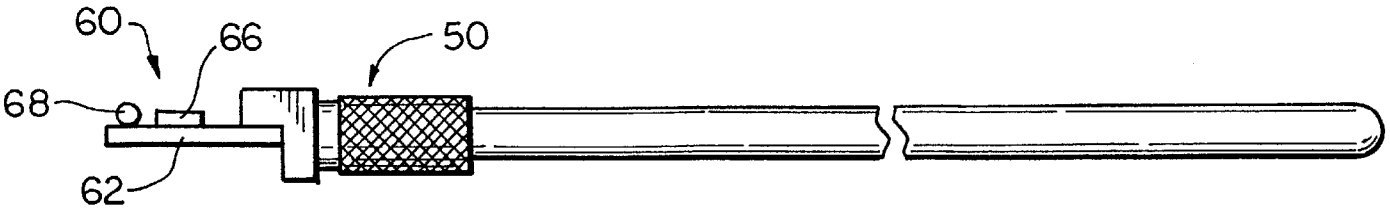
FIG. 6A is a side view of the termination chip and terminal of FIG. 6.

Referring now to FIGS. 6 and 6A the termination chip 60 is shown. Termination chip 60 comprises a substrate 62 which includes surface mount termination resistor 64, a surface mount termination capacitor 66, a wire contact 68 and a mating surface 69. While a resistor and capacitor are discussed, it should be appreciated that other termination components could be used, as well as various numbers of components, dependent upon the amount and type of termination desired. As shown, the mating surface 69 is in secure mechanical and electrical communication with the second end of pin terminal 50. The wire contact 68 in this embodiment is a 0.031 wire which provides a larger conductive path between the termination chip and the body of the terminator and the compression ring when the terminator is assembled. Prior art terminators used a 0.008 steel wire which made a point contact against the main body. A problem associated with prior art terminators was intermodulation distortion which resulted from the point contact of the wire contact (typically a 0.008 diameter steel wire) with the body.

Typical values for the termination components described in this embodiment are 75 ohms for the resistor and 0.010 microfarads for the capacitor, though other values or components may also be utilized. The termination components may be configured to be in parallel with each other, with one end in electrical communication with the terminal 50 and the other end in electrical communication with the body of the terminator through the wire. Alternatively, the components could be configured in series with each other, such that a first end of the resistor is in electrical communication with the first end of the capacitor, and the second end of the resistor in electrical communication with the terminal while the second end of the capacitor is in electrical communication with the body; or wherein the second end of the resistor is in electrical communication with the body with the second end of the capacitor in communication with the terminal.

Referring back to FIG. 1, the terminator 10 is assembled as follows. The termination chip 60 is installed onto the second end of the pin terminal 50 by soldering, conductive epoxy or other known interconnection means such that the termination chip 60 is mechanically supported by the terminal 50, as well as one contact of the termination chip 60 in electrical communication with the terminal 50. The terminal 50 and termination chip 60 are inserted into the bore of body 20 such that the termination chip is farthest into the body and the wire contact of the termination chip is abutting the interior surface of the body 20. The compression ring 40 is then placed over the first end of terminal 50 and slid down the terminal 50 into body 20. One end of the compression ring 40 is in contact with the wire contact of the termination chip 60, while the compression ring itself is also in electrical communication with body 20. Insulator 30 is then placed over the first end of terminal 50 and slid down terminal 50 such that insulator 30 is within body 20. The first end of body 20 is then crimped, thus securing the first end of terminal 50 and termination chip 60, the compression ring 40, and the insulator 30 within the bore of body 20. The compression ring 60 is now biasing the wire contact of termination chip 60 against body 20, thereby providing for secure electrical and mechanical connection of the termination chip 60 to the body 20. Accordingly, since the connection between the termination chip 60 and the body 20 is much improved by way of utilizing a larger diameter wire and a compression ring, the amount of intermodulation distortion associated with prior art terminators is minimized or removed entirely.

In use, the terminator 10 is inserted into a cooperative connector, such that the first end of terminal 50 is in electrical and mechanical communication with the center conductor of the cooperating connecter. As the terminator body 20 is brought into contact and threadably engaged with the body of the cooperating connector, a ground connection is established between the body of the terminator and the body of the cooperating connector. O-ring 70 may be utilized to provide a weather tight seal between the terminator 10 and the connector when the terminator 10 is mated with the connector. The termination chip 60 is thus interconnected at one contact with the terminal 50 and at another contact with a ground of the system through body 20, thereby allowing the termination components to actively terminate the signal on the center conductor of the cooperating connector with out the internal components being damaged since torsional, tensile and bending stresses associated with the terminator being installed onto the cooperating connector are absorbed by the insulator.

The electrical performance of the terminator has been improved as compared to prior art terminators. This assembly has very low return loss (less the 30 dB to 1 GHz) and eliminates signal reflection and intermodulation distortion or return path distortion. In prior terminators the levels of intermodulation distortion were in the 5 to 40 MHz band; with the present invention the levels of intermodulation distortion are undetectable. Therefore, as discussed above, the level of intermodulation distortion is greatly reduced or removed, and the stresses associated with installing or removing the terminator are minimized, thereby providing a high reliability and high performance termination.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

We claim:

1. A terminator comprising:

a body open on a first end, said body having a central bore partially disposed therein, the first end of said body capable of mating with a cooperating connector;

a terminal having a first end and a second end, the first end of said terminal extending beyond the first end of said body, the second end of said terminal disposed along said common longitudinal axis within said body;

an insulator disposed along said common longitudinal axis within said body, having a bore disposed therethrough adapted to support a portion of said terminal, said insulator capable of absorbing stresses from said terminal;

a compression ring having a central bore disposed therethrough, said compression ring disposed along said common longitudinal axis within said body and in electrical communication with said body; and a termination chip disposed within said body, said termination chip having a first contact for providing electrical communication with said compression ring and said body, and a second contact for providing electrical communication with said terminal.

2. The terminator of claim 1 wherein said terminal includes a textured surface for providing frictional contact with said insulator.

3. The terminator of claim 1 wherein said terminator includes an o-ring disposed about an outside surface of said body.

4. The terminator of claim 1 wherein said termination chip comprises:

a substrate; and a termination component disposed on said substrate.

5. The terminator of claim 4 wherein said termination component comprises a resistor.

6. The terminator of claim 5 wherein said resistor has a value of approximately 75 ohms.

7. The terminator of claim 4 wherein said termination component comprises a capacitor.

8. The terminator of claim 7 wherein said capacitor has a value of approximately 0.010 microfarads.

9. The terminator of claim 1 wherein said terminal, said compression ring, and said body are comprised of electrically conductive material.

10. The terminator of claim 1 wherein said termination chip includes a contact for establishing electrical communication between said termination chip and said body.

11. The terminator of claim 10 wherein said first contact comprises a piece of wire.

12. The terminator of claim 11 wherein said wire has a diameter of approximately 0.031 inches.

13. The terminator of claim 2 wherein said textured surface comprises a knurled surface.

14. The terminator of claim 2 wherein said textured surface comprises a ridged surface.

15. The terminator of claim 1 further comprising an o-ring disposed about an outside surface of said body.

16. The terminator of claim 1 wherein said body includes a section having a hexagonally shaped exterior surface.

17. The terminator of claim 9 wherein said body comprises aluminum.

18. The terminator of claim 9 wherein said compression ring and said terminal comprise brass.

* * * * *